US006263868B1

(12) United States Patent
Koch et al.

(10) Patent No.: US 6,263,868 B1
(45) Date of Patent: Jul. 24, 2001

(54) GAS STOVE BURNER

(75) Inventors: Jürgen Koch, Attendorn (DE); Randy Rummel, Huntington Beach; Dennis Dacey, Long Beach, both of CA (US)

(73) Assignee: AGT Gas Technology GmbH, Attendorn (DE)

( * ) Notice: Subject to any disclaimer, the term of this patent is extended or adjusted under 35 U.S.C. 154(b) by 0 days.

(21) Appl. No.: 09/500,343

(22) Filed: Feb. 8, 2000

(30) Foreign Application Priority Data

Feb. 9, 1999 (DE) ..... 199 05 198

(51) Int. Cl.[7] ..... F24C 3/00; F23Q 9/00

(52) U.S. Cl. ..... 126/39 R; 126/39 E; 431/278; 431/354; 239/444

(58) Field of Search ..... 126/39 R, 39 B, 126/39 E; 431/354, 350, 258, 264, 266, 278, 280, 285; 239/444, 443

(56) References Cited

U.S. PATENT DOCUMENTS

| | | | | |
|---|---|---|---|---|
| 4,305,372 | * | 12/1981 | Hahn | 431/278 |
| 4,886,043 | * | 12/1989 | Homer | 129/39 R |
| 5,139,417 | * | 8/1992 | Ghassemzadeh | 431/354 |
| 5,277,576 | * | 1/1994 | Hartung et al. | 126/39 R |
| 5,639,232 | * | 6/1997 | Bogenschutz et al. | 431/354 |
| 5,765,542 | * | 6/1998 | Fey et al. | 126/39 E |

FOREIGN PATENT DOCUMENTS

| | | | |
|---|---|---|---|
| 70 158 | | 2/1917 | (AT) . |
| 488969 | | 4/1970 | (CH) . |
| 78 156 | | 11/1894 | (DE) . |
| 580 338 | | 6/1933 | (DE) . |
| 1931901 | | 2/1966 | (DE) . |
| 0081470 | | 6/1983 | (EP) . |
| 0485645 | | 5/1992 | (EP) . |
| 2728956 | | 7/1996 | (FR) . |
| 285 067 A | | 5/1928 | (GB) . |
| 1 364 890 | * | 8/1974 | (GB) . |

* cited by examiner

*Primary Examiner*—Ira S. Lazarus
*Assistant Examiner*—Josiah C Cocks
(74) *Attorney, Agent, or Firm*—Herbert Dubno; Andrew Wilford

(57) ABSTRACT

A gas stove burner has a base having an annular outer edge and a lower ring sitting on the base, forming therewith a lower compartment, and having an outer edge forming with the base outer edge an outwardly open annular slot communicating with the lower compartment. An upper ring sitting on the lower ring forms therewith an upper compartment and has an outer edge forming with the lower-ring outer edge an array of outwardly open holes communicating with the upper compartment. The upper-ring outer edge has a diameter generally equal to a diameter of the lower-ring outer edge. A gas/air mixture is fed to each of the compartments so that the gas will issue from the holes to form an upper flame and from the slot to form a lower flame of substantially the same diameter.

7 Claims, 2 Drawing Sheets

GAS STOVE BURNER

FIELD OF THE INVENTION

The present invention relates to a burner. More particularly this invention concerns a gas burner for a cook stove.

BACKGROUND OF THE INVENTION

A high-quality stove gas burner typically can produce a relatively large main flame and a smaller warming flame. The latter is normally set such that it cannot exceed a certain size, so that it can be used for simmering or warming but is not really powerful enough for most cooking procedures. The main flame is produced from nozzles that have an overall flow cross section that is much greater than the nozzles forming the warming flame. Typically the warming flame produces about 20% to 25% as much heat as the main flame.

In some systems the warming flame is centered in the burner and in this case it can be even smaller, between 10% and 12% of the overall burner capacity. While this is very handy for most applications, the centered position of this flame creates a hot spot in the center of the cooking utensil sitting on the burner, and in fact food can be burnt because of this concentrated location even in spite of the small size of the flame. Another disadvantage with this system is that a separate igniter must often be provided for the central flame, adding to the cost of the burner, and in general such a dual-flame burner can be quite complex.

OBJECTS OF THE INVENTION

It is therefore an object of the present invention to provide an improved gas stove burner.

Another object is the provision of such an improved gas stove burner which overcomes the above-given disadvantages, that is which has low-heat warming flame whose effect is spread out, and which is of simple construction.

SUMMARY OF THE INVENTION

A gas stove burner has according to the invention a base having an annular outer edge and a lower ring sitting on the base, forming therewith a lower compartment, and having an outer edge forming with the base outer edge an outwardly open annular slot communicating with the lower compartment. An upper ring sitting on the lower ring forms therewith an upper compartment and has an outer edge forming with the lower-ring outer edge an array of outwardly open holes communicating with the upper compartment. The upper-ring outer edge has a diameter generally equal to a diameter of the lower-ring outer edge. A gas/air mixture is fed to each of the compartments so that the gas will issue from the holes to form an upper flame and from the slot to form a lower flame of substantially the same diameter.

Thus with this system the warming flame is of the same diameter as the cooking flame. The heat it produces will therefore be spread out over the pot on the burner for effective warming or simmering without any dangerous hot spots. What is more the provision of the warming flame below the cooking flame allows it to be used to ignite the cooking flame, and vice versa, so that the construction of the burner is greatly simplified. The propagation of the warming flame through a gap has the advantage that it will ignite fully and stay ignited, as opposed to the problems of trying to keep a plurality of weak jets illuminated.

According to the invention a central inlet projects through the base and into the upper compartment and is connected to the gas/air feed. Another inlet projects through the base and into the lower compartment between the central inlet and the lower-ring edge and is also connected to the gas/air feed. The gas supply connected to the inlets includes independently operable and closable valves for feeding separate flows of a gas/air mixture to the compartments so that either of the flows can be completely cut off to completely eliminate the respective flame. Thus the upper cooking flame can be used independently or in addition to the lower warming flame, and the lower warming flame can be used alone.

The edges of the rings and base are all of generally the same diameter so that the flames are also of generally the same diameter. In addition the rings are circular and the lower-ring outer edge has an upwardly flaring frustoconical upper surface. The upper ring outer edge has a complementary and parallel lower surface spaced from the lower-ring upper surface and forming the slot therewith. The rings are circular and the upper-ring outer edge has a downwardly directed lower surface engaging an upwardly directed upper surface of the lower-ring outer edge and formed with an array of downwardly open notches forming the holes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
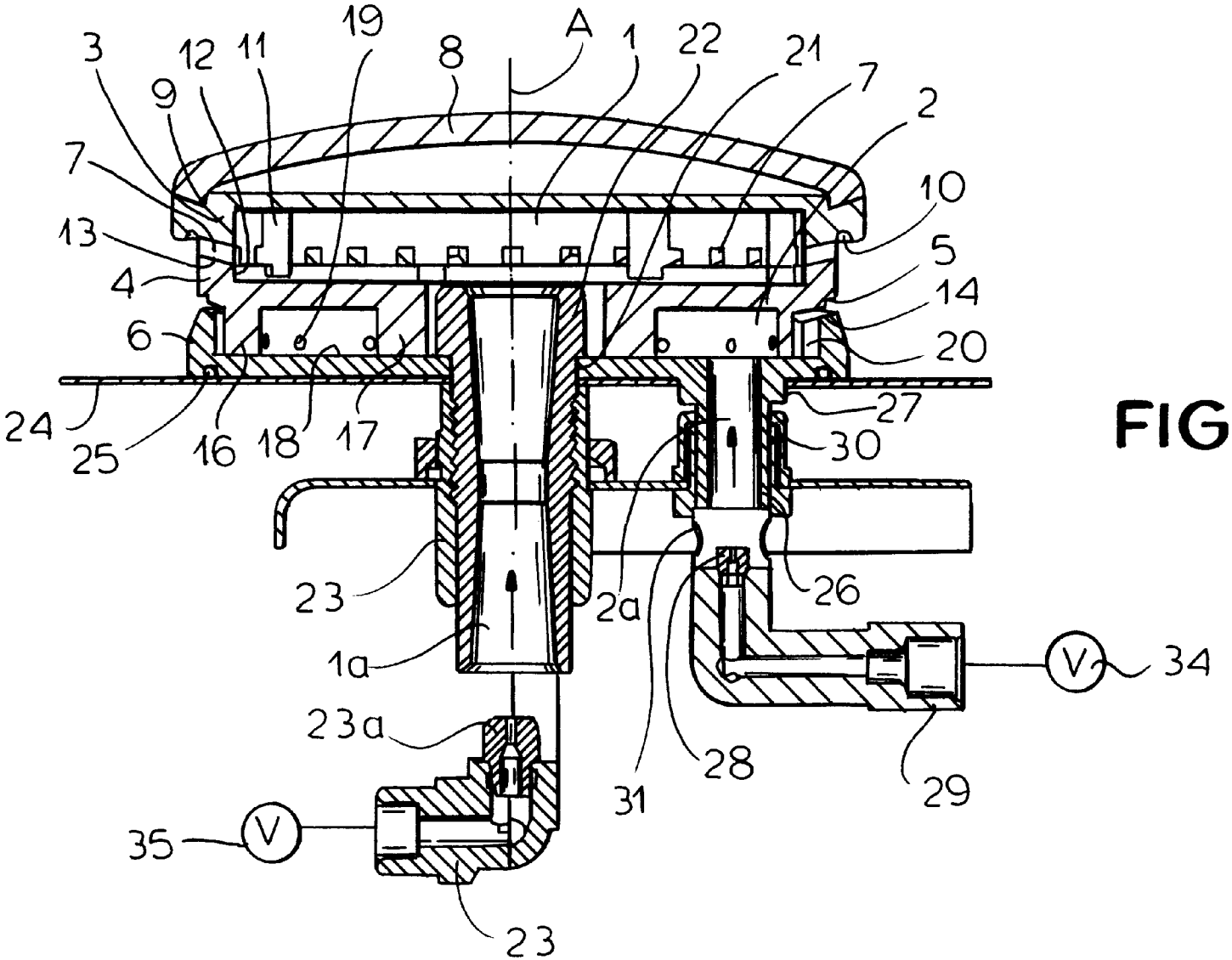
FIG. 1 is a partly diagrammatic vertical section through the burner according to the invention.

As seen in FIG. 1 a burner according to the invention is centered on a vertical axis A and basically comprises a circular base plate 6 sitting on a surface 24 of a stove, a lower ring 4 sitting on the base plate 6, an upper ring 3 sitting on the lower ring 4, and a cover plate 8 atop the upper ring 3. An inlet 1*a* comprised of an axially centered feed tube 22 set in a central hole 21 of the ring 4 fits in a socket tube 23 of the stove and is supplied with an air-gas mixture from a nozzle 23*a* of a supply fitting 23. Another inlet 2*a* offset from the axis A is comprised of a tubular nipple 26 fitting in a tube 30 mounted on the stove and having a blender 31 and a nozzle 28 connected to another supply fitting 29 for supply of an air/gas mixture. The nipple 26 has an enlarged upper end 27 that fits in a complementary hole in the stove surface 24 to lock the burner in place against rotation about the axis A. An O-ring 25 set in the base plate 6 engages the stove surface 24 to prevent spills or the like from getting under the burner.

Figure 2:
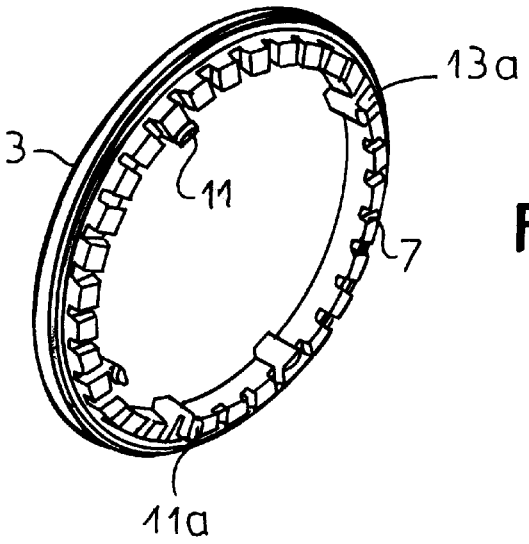
FIG. 2 is a perspective view from below of the upper ring of the burner.

The top ring 3 as also shown in FIG. 2 has a frustoconical and upwardly flaring lower edge 13*a* formed with a uniform array of downwardly open hole-forming notches 7 that open into an upper compartment 1 defined between the rings 3 and 4 and into which the upper end of the inlet 1*a* also opens. Immediately above the notches 7 the ring 3 is formed with a downwardly directed annular flame-diverting notch 10. The floor of this compartment 1 is defined by an upper surface of the lower ring 4 which has an upwardly flaring outer-edge upper surface 13 (FIG. 3) complementary to the surface 13*a* and engaging same in surface contact. Inwardly directed tabs 11 and 11*a* of the upper ring 3 fit in notches 11*b* of an inner surface 12 of the lower ring to center the upper ring 3 in the lower ring 4 and prevent the upper ring 3 from rotating about the axis A in the lower ring 4. One of the tabs 11*a* and the respective notch 11*b* are wider than the other tabs 11 so as to define one position only for the two parts 3 and 4 to fit together. The cover disk 8 is upwardly convexly rounded and fits with a rim 9 in a groove at the outer edge of the upper ring 3 to hold it on center.

Figure 3:
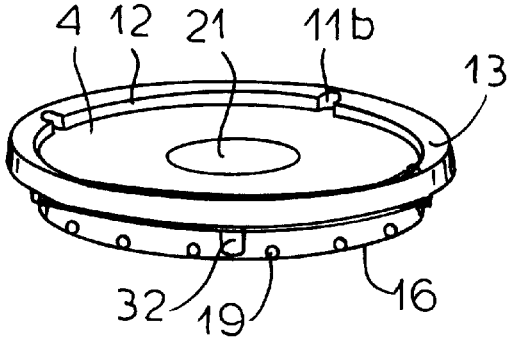
FIG. 3 is a perspective view from above of the lower ring of the burner.
Figure 4:
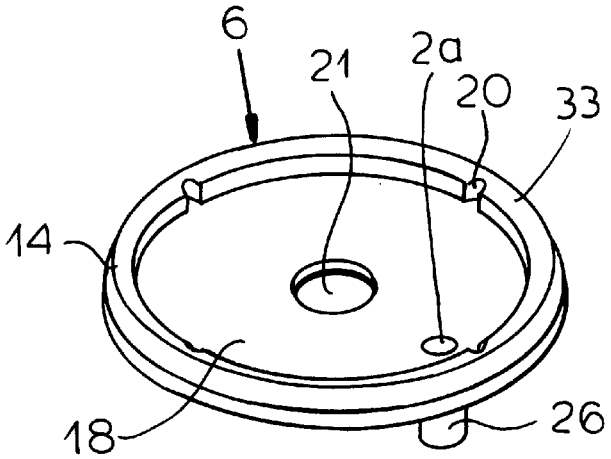
FIG. 4 is a perspective view from above of the base plate of the burner.

The lower ring as also shown in FIG. 3 has a pair of downwardly directed cylindrical webs 16 and 17 defining with an upper surface 18 of the base plate 6 an annular lower compartment 2 into which the inlet 2*a* opens. An array of angularly equi-spaced and radially throughgoing holes 19 in the outer web 16 direct the air/gas mixture in the lower compartment 2 into the gap between a lower surface 14 of the outer edge of the lower ring 4 and an upper surface 33 (FIG. 4) of the outer edge of the base plate 6. The two surfaces 14 and 33 together form an outwardly and upwardly open lower-flame gap 5 below the holes 7. Radially outwardly projecting lugs 32 formed on the lower ring 4 fit in complementary inwardly open notches 20 of the base plate 6 to center the ring 4 and prevent it from rotating.

Thus when a valve 34 connected to the compartment 2 is opened, a gas/air mixture created at the blender 31 will flow out the holes 19 and thence emerge as an annular radially outwardly directed sheet from the gap 5. When ignited, the resultant flame can be adjusted down to a very low level for simmering or warming something sitting above the burner.

When a valve 35 connected to the compartment 1 and operable independently of the valve 34 is opened a substantially greater flow of gas will issue from the notch holes 7, as the overall flow cross section of the notch holes 7 is greater than that of the gap 5. If the lower flame is burning, it will automatically ignite these flows from the holes 7. The upper flame is substantially more robust than the lower one and can be used individually for cooking and even in combination with the lower flame. Either flame can be used independently and both together give a burner of considerable capacity.

We claim:

1. A gas stove burner comprising:

a base having an annular outer edge;

a lower ring sitting on the base, forming therewith a lower compartment, and having an outer edge forming with the base outer edge an outwardly open annular slot communicating with the lower compartment;

an upper ring sitting on the lower ring, forming therewith an upper compartment, and having an outer edge forming with the lower-ring outer edge an array of outwardly open holes communicating with the upper compartment, the upper-ring outer edge having a diameter generally equal to a diameter of the lower-ring outer edge; and means including respective independently operable and closable valves connected to the compartments for feeding respective gas/air mixtures to the compartments such that when both valves are open the gas will issue from the holes to form an upper flame and from the slot to form a lower flame of substantially the same diameter and when either of valves is closed the respective flow is completely cut off to completely eliminate the respective flame.

2. The gas stove burner defined in claim 1, further comprising a central inlet projecting through the base and into the upper compartment and connected to the gas/air feed means.

3. The gas stove burner defined in claim 2, further comprising an inlet projecting through the base and into the lower compartment between the central inlet and the lower-ring edge and connected to the gas/air feed means.

4. The gas stove burner defined in claim 3 wherein the valves are connected to the inlets.

5. The gas stove burner defined in claim 1 wherein the edges are all of generally the same diameter, whereby the flames are also of generally the same diameter.

6. The gas stove burner defined in claim 1 wherein the rings are circular and the lower-ring outer edge has an upwardly flaring frustoconical upper surface, the upper ring outer edge having a complementary and parallel lower surface spaced from the lower-ring upper surface and forming the slot therewith.

7. The gas stove burner defined in claim 1 wherein the rings are circular and the upper-ring outer edge has a downwardly directed lower surface engaging an upwardly directed upper surface of the lower-ring outer edge and formed with an array of downwardly open notches forming the holes.

* * * * *